US005490637A

United States Patent [19]

Golesis

[11] Patent Number: 5,490,637

[45] Date of Patent: Feb. 13, 1996

[54] METAL SHREDDING MACHINE

[76] Inventor: Kyriakos Golesis, 6125 E. Indian School Rd. #280, Scottsdale, Ariz. 85251

[21] Appl. No.: 210,621

[22] Filed: Mar. 18, 1994

[51] Int. Cl.[6] ..... B02C 13/04; B02C 13/28

[52] U.S. Cl. ..... 241/194; 241/300

[58] Field of Search ..... 241/189.1, 191, 241/194, 197, 300

[56] References Cited

U.S. PATENT DOCUMENTS

| | | | |
|---|---|---|---|
| 4,222,530 | 9/1980 | Whitney | 241/197 X |
| 4,241,882 | 12/1980 | Baihoff | 241/191 X |
| 4,313,575 | 2/1982 | Stepanek | 241/197 X |
| 4,406,415 | 9/1983 | Greer | 241/197 X |
| 4,650,129 | 3/1987 | Newell et al. | 241/197 X |
| 4,997,136 | 3/1991 | Becker | 241/191 X |
| 5,188,303 | 2/1993 | Hoof | 241/197 X |

*Primary Examiner*—Timothy V. Eley
*Attorney, Agent, or Firm*—Tod R. Nissle

[57] ABSTRACT

A metal shredding machine includes spaced apart support plates which are interconnected by rods carrying hammers. The hammers contact and shred metal which is passing through the machine. Sleeves are mounted on the peripheral edges of the plates. The sleeves reduce the frequency of breakage and replacement of the support plates.

2 Claims, 2 Drawing Sheets

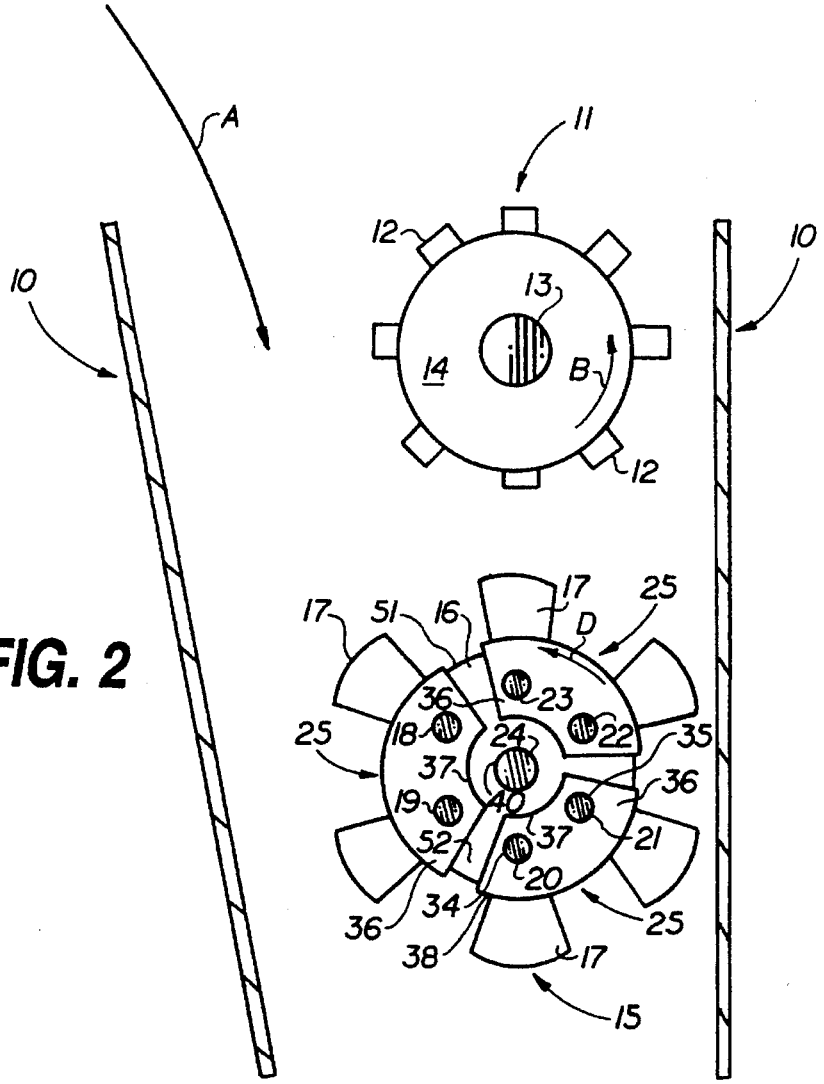
FIG. 2
FIG. 1
PRIOR ART
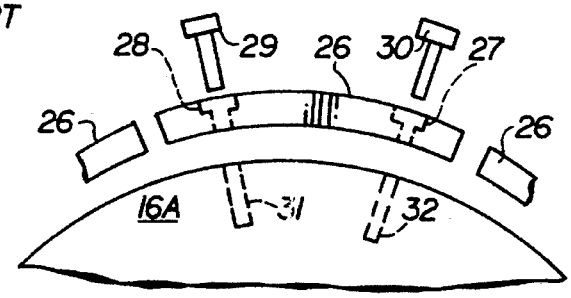

METAL SHREDDING MACHINE

BACKGROUND OF THE INVENTION

This invention relates to apparatus for shredding metal.

More particularly, the invention relates to shredding apparatus which includes a plurality of spaced apart parallel rotating support plates which are interconnected by elongate rods carrying hammers which contact and shred metal.

In a further respect, the invention relates to shredding apparatus of the type described which reduces the frequency of breakage and replacement of the support plates.

Metal shredding machinery is well known in the art and typically comprises costly, massive machinery capable of shredding an automobile which is fed into the machinery. Such machinery includes spaced apart parallel circular metal support plates mounted on a rotating shaft. Each support plate is of equal shape and dimension and includes six holes formed through the plate. The holes are equidistant from the center of the support plate. Each adjacent pair of holes is equally spaced apart by an arc distance equal to about sixty degrees. The holes in one support plate are aligned with the holes in the other support plates. Each group of aligned holes is termed a set of holes. Each of six rods extends through one set of holes in the support plates. The six rods are spaced apart and parallel to the rotating shaft. Hammers are mounted on the rods and extend outwardly from the plates. The hammers contact and shred metal passing through the machinery. Each support plate includes an outer peripheral edge and a pair of opposed circular side faces. Arcuate edge guard segments are bolted onto the peripheral edge of each plate. The purpose of the arcuate edge guard segments is to protect the peripheral edges of the support plates and extend the operational life of the plates. Since the support plates are massive, and the machinery must be stopped and disassembled to replace a damaged plate, the replacement of a damaged plate is an expensive proposition.

Accordingly, it would be highly desirable to provide improved metal shredding machinery of the type described which would extend the operational life of a circular metal plate and significantly reduce the maintenance and repair costs associated with operating such machinery.

Therefore, it is an object of the invention to provide improved metal shredding machinery.

A further object of the invention is to provide improved metal shredding machinery of the type including a plurality of spaced apart parallel rotating support plates which are interconnected by elongate rods carrying hammers which contact and shred metal.

Another object of the invention is to provide improved metal shredding machinery of the type described which increases the structural strength of the rotating support plates and significantly increases the operational life of the machinery.

BRIEF DESCRIPTION OF THE DRAWINGS

These and other, further and more specific objects and advantages of the invention will be apparent to those skilled in the art from the following detailed description thereof, taken in conjunction with the drawings, in which:

FIG. 1 is a partial front view of prior art metal shredding machinery;

FIG. 2 is a front elevation view illustrating metal shredding machinery constructed in accordance with the principles of the invention;

SUMMARY OF THE INVENTION

Figure 3:
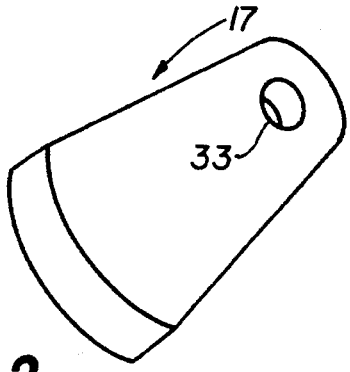
FIG. 3 is a perspective view illustrating a hammer utilized in the machinery of FIG. 2.

Briefly, in accordance with my invention, I provide apparatus for shredding metal. The apparatus includes a frame; a rotating shaft mounted in the frame; a plurality of spaced apart plates mounted on and extending outwardly from said rotating shaft, each of the plates having an outer peripheral edge and a pair of opposing spaced apart side surfaces; a plurality of aligned apertures formed through the plates; an elongate rod fixed in the apertures, extending between the plates, and generally parallel to the rotating shaft; a hammer mounted on the shaft intermediate an adjacent pair of the plates and extending outwardly from the plates away from the rotating shaft to contact and shred metal; and, a plurality of sleeves protecting at least portions of the peripheral edge and side surfaces of the plates. Each of the sleeves includes a back adjacent at least a portion of the peripheral edge of one of the plates; a pair of arms connected to and extending outwardly from the back, each arm extending over a different one of said pair of side surfaces of one of said plates; and, a pair of apertures each formed through a different one of the arms. The rod passes through the apertures to retain the sleeve in position on one of the plates to protect the peripheral edge and side surface of the plate.

DESCRIPTION OF PREFERRED EMBODIMENT OF INVENTION

Turning now to the drawings, which depict the presently preferred embodiments of the invention for the purpose of illustrating the practice thereof and not by way of limitation of the scope of the invention, and in which like reference characters refer to corresponding elements throughout the several views, FIG. 1 illustrates a circular support plate 16A utilized in prior art metal shredding machinery. A plurality of arcuate edge-guard segments 26 are attached to the cylindrical peripheral edge of plate 16A by externally threaded nut 29, 30 which extend through apertures 27 and 28 in a segment 26 and are turned into internally threaded openings 32 and 31, respectively, formed in plate 16.

The presently preferred embodiment of the invention is depicted in FIG. 2 and includes a frame 10 into which entire automobiles or other sources of metal scrap are dispensed in the direction indicated by arrow A. Scrap metal input in the direction of arrow A normally contacts feed roller 11 which downwardly forces the scrap metal toward the shredder assembly 15.

Feed roller 11 includes on elongate cylindrical member 14 mounted for rotation on horizontally oriented shaft 13 in the direction of arrow B in FIG. 2. Outwardly extending spaced apart bars 12 are attached to the arcuate outer surface of member 14 and are parallel to shaft 13. Bars 12 engage scrap metal and facilitate the downward displacement of the metal in the direction of arrow A.

Figure 5:
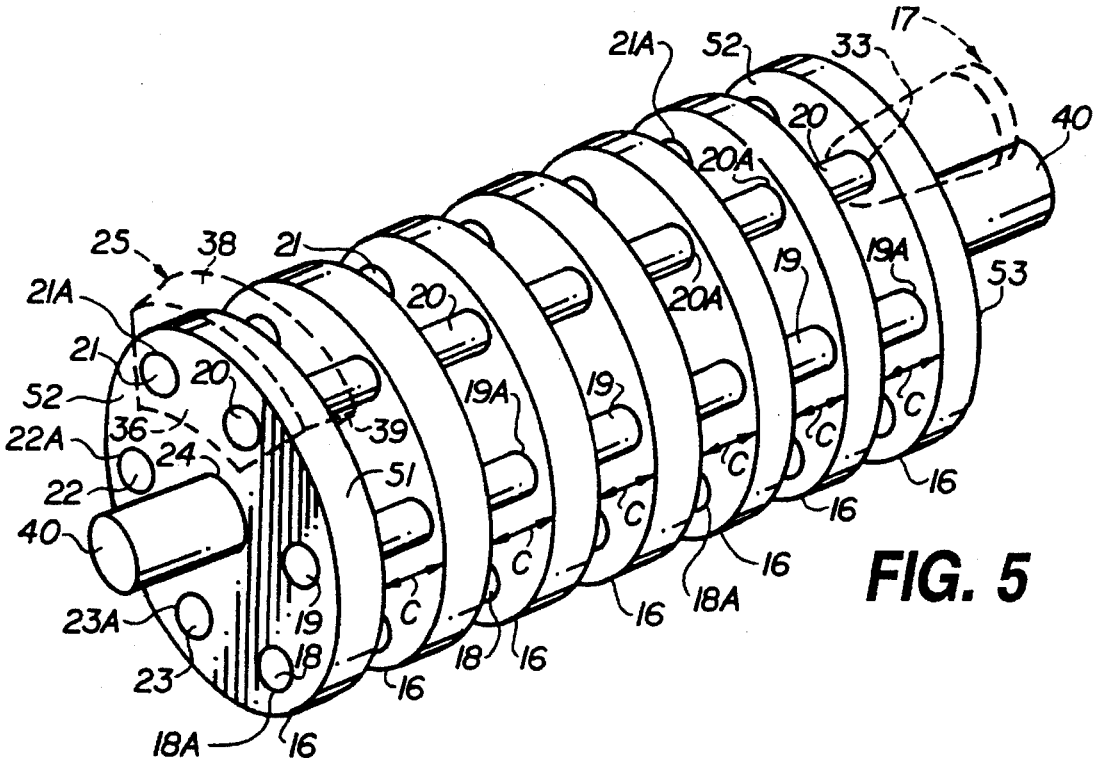

Shredder assembly 15, as can be seen in FIGS. 2 and 5, includes a plurality of circular, spaced apart, metal plates 16 of equal shape, contour, and dimension mounted on horizontally oriented rotating shaft 40. Shaft 40 slides through apertures 24 formed at the center of each plate 16. Any desired prior art motive power system can be used to rotate shaft 40 and plates 16 in the direction of arrow D in FIG. 2. Each plate 16 includes six equal sized apertures 18A, 19A, 20A, 21A, 22A, 23A formed therethrough. The six apertures 18A to 23A each lie on an imaginary circle. This imaginary circle and cylindrical shaft 40 are concentric. Apertures 18A to 23A are placed along the imaginary circle at sixty degree intervals. Each plate 16 has a pair of opposing, spaced apart circular side surfaces 52 and 53.

As can be seen in FIG. 5, plates 16 are mounted on shaft 40 such that the apertures 18A to 23A in one plate are aligned with the corresponding apertures 18A to 23A in each of the other plates so that an elongate cylindrical rod 20 can be slidably inserted and removably fixed in apertures 20A; so that an elongate cylindrical rod 21 can be inserted and removably fixed in apertures 21A; so that an elongate cylindrical rod 22 can be inserted and removably fixed in apertures 22A; so that an elongate cylindrical rod 23 can be inserted and removably fixed in apertures 23A; so that an elongate cylindrical rod 18 can be inserted and removably fixed in apertures 18A; and, so that an elongate cylindrical rod 19 can be inserted and removably fixed in apertures 19A. Set screws or any other desired prior art means can be used to secure rods 18 to 23 in apertures 18A to 23A, respectively.

When a rod 20 is being slidably inserted through apertures 20A, a hammer 17 can be positioned intermediate each adjacent pair of plates 16 such that aperture 33 (FIG. 3) of hammer 17 is aligned with apertures 20A. This permits rod 20 to slide through aperture 33 to secure hammer 17 on rod 20 in the manner indicated by dashed lines 17 in FIG. 5. In FIG. 5, a hammer 17 can, if desired, be similarly mounted on rod 20 (and rods 18, 19, 21 to 23) intermediate each adjacent pair of plates 16. FIG. 2 shows a hammer 17 mounted on each of rods 18 to 23 intermediate an adjacent pair of plates 16. Hammers 17 can be fixedly removably secured to a rod 18 to 23 by a set screw or other means or can be permitted to freely pivot on the rod. Each rod 18 to 23 is of equivalent shape and dimension. Each pair of plates 16 in FIG. 5 is equidistant, as indicated by arrows C, from adjacent plates 16. The distance, indicated by arrows C, between an adjacent pair of plates 16 is greater than the distance in prior art machines in order to make space for arms 36 and 39 of sleeves 25. In prior art machines, spacers are mounted on shaft 40 between each adjacent pair of plates 16 to position each pair of plates 16 a selected distance apart. In order to retrofit a prior art machine, the existing spacers, which are typically now five inches long, are replaced with new spacers which are about eight inches long. Consequently, when the new spaces are installed intermediate each pair of adjacent plates 16, the distance indicated by arrows C is eight inches.

Figure 4:
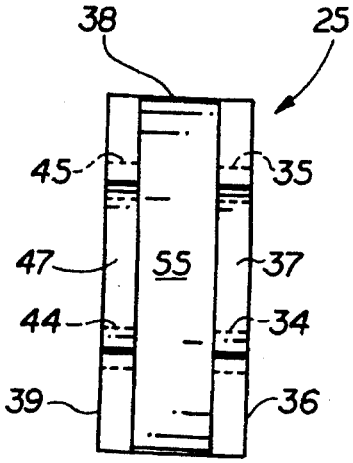
FIG. 4 is a front view of a sleeve utilized in the machinery of FIG. 2; and, FIG. 5 is a perspective view of a support plate assembly utilized in the invention.

The protective sleeve 25 of the invention is illustrated in FIGS. 2 and 4 and includes arcuate back 38 with arcuate inner surface 55. A pair of arms 36 and 39 are connected to and extend outwardly from back 38. Apertures 34 and 35 are formed through arm 36. Apertures 44 and 45 are formed through arm 39. Apertures 35 and 35 are aligned with one another. Apertures 34 and 44 are aligned with one another. Leg 36 tapers to inner arcuate surface 37. Leg 39 tapers to inner arcuate surface 47.

When a pair of rods 20 and 21 is being slidably inserted through apertures 20A and 21A, respectively, a sleeve 25 can be mounted on a plate 16 in the manner illustrated in FIGS. 5 and 2 by first positioning the sleeve 25 with arms 36 and 39 bracketing plate 16 such that apertures 34 and 44 are aligned with aperture 20A and apertures 35 and 45 are aligned with aperture 21A. This permits rod 20 to be slid sequentially through aperture 34, through aperture 20A intermediate apertures 34 and 44, through aperture 44, and through the remaining apertures 20A to secure sleeve 25 on rod 20 in the manner indicated in FIG. 2 and by dashed lines 17 in FIG. 5. Rod 21 is similarly slid sequentially through aperture 35, through aperture 21A intermediate apertures 35 and 45, through aperture 45, and through the remaining apertures 21A to secure sleeve 25 on rod 21 in the manner indicated in FIG. 2 and by dashed lines 17 in FIG. 5. Sleeves 25 can be similarly mounted on each plate 16 by using rods 22, 23, 18, 19 in the manner illustrated in FIG. 2.

When a sleeve 25 is mounted on a plate 16, the inner arcuate surface 55 is adjacent and can, if desired, contact peripheral edge 51 of plate 16. Surface 55 preferably, but not necessarily, conforms to edge 51. Arms 36 and 39 each extend over, are adjacent to, and can contact portions of side surfaces 52 and 53, respectively, of a plate 16. The use of sleeves 25 is advantageous because they are mounted on existing rods 18 to 23, because they do not require the drilling of additional mounting holes in a plate 16, because they protect the side surfaces and well as the peripheral edge of each plate 16, because they improve the structural integrity of a plate 16, and because they significantly extend the operational life of a plate 16 to avoid large maintenance and repair costs.

Having described the invention in such terms as to enable those skilled in the art to understand and practice it, and having described the presently preferred embodiments thereof, I claim:

1. In combination with apparatus for shredding metal including a frame, a rotating shaft mounted in said frame, a plurality of generally cylindrical spaced apart plates mounted on and extending outwardly from the rotating shaft, each of the plates having an outer peripheral edge and a pair of opposing spaced apart side surfaces, first spacer means for maintaining each adjacent pair of the plates a selected distance apart, a plurality of aligned apertures formed through the plates and spaced apart from the rotating shaft, an elongate rod fixed in the apertures, extending between the plates, and generally parallel to the rotating shaft, a hammer mounted on the shaft intermediate an adjacent pair of the plates and extending outwardly from the plates away from the rotating shaft to contact and shred metal, the improvements comprising (a) second spacer means for altering the space between each adjacent pair of the plates to be greater than the selected distance; and, (b) a plurality of U-shaped sleeves protecting portions of the peripheral edge and side surfaces of each of said adjacent pair of plates, each of said sleeves including (i) an arcuate back adjacent a portion of the peripheral edge of one of said adjacent pair of plates, said back having a pair of ends each spaced apart from one of the ends of the arcuate back of another adjacent sleeve on the peripheral edge of said one of said adjacent pair of plates, (ii) a pair of spaced apart arms connected to said back and extending outwardly from said back, each of said arms spaced away from said rotating shaft and extending over a portion of one of said pair of side surfaces of said one of said adjacent pair of plates, having side edges which each extend away from the outer peripheral edge of said one of said adjacent pair of plates, which each extend over said one of said pair of side surfaces of said one of said plates, and which are each spaced apart from a side edge of another adjacent sleeve on said one of said adjacent pair of plates, and extending outwardly away from said one of said pair of side surfaces of said one of said adjacent pair of plates and toward the other of said adjacent pair of plates, (iii) an aperture formed through said arms, said rod passing through said aperture to retain said sleeve in position on said one of said adjacent pair of plates to protect said portions of the peripheral edge and side surface of said one of said adjacent pair of said plates;

said hammer being positioned intermediate one of said sleeves on one of said adjacent pair of plates and one of said sleeves on the other of said adjacent pair of plates, and being spaced apart from each of said adjacent pair of plates, said sleeves, said adjacent pair of plates, said hammer, and said rotatable shaft defining a first open area for receiving and permitting the passage of shredded metal, said open area extending between said pair of adjacent plates, said sleeves and said rotatable shaft, and said hammer and said rotatable shaft, said sleeves and said pair of adjacent plates defining second open areas each extending between adjacent pair of said sleeves on each of said pair of adjacent plates, said second open areas each extending between said side edges of adjacent pairs of said sleeves on each of said pair of adjacent plates.

2. The apparatus of claim 1, wherein said side edges of adjacent sleeves on one of said adjacent pair of plates taper inwardly away from said outer peripheral edge of said one of said adjacent pair of plates.

* * * * *